US006029839A

United States Patent [19]

Mansouri

[11] Patent Number: 6,029,839

[45] Date of Patent: Feb. 29, 2000

[54] COLLAPSIBLE SHIPPING CONTAINER

[76] Inventor: Hossein Mansouri, 11261 Richmond Ave., Ste 103, Houston, Tex. 77082

[21] Appl. No.: 09/129,727

[22] Filed: Aug. 5, 1998

[51] Int. Cl.[7] ..... B65D 6/22

[52] U.S. Cl. ..... 220/4.31; 206/597; 206/600; 220/495.06; 220/571; 220/DIG. 6

[58] Field of Search ..... 220/4.31, 4.33, 220/4.34, 498.06, 571, DIG. 6; 206/297, 600

[56] References Cited

U.S. PATENT DOCUMENTS

| | | | |
|---|---|---|---|
| 3,266,656 | 8/1966 | Kirdle . | |
| 4,421,253 | 12/1983 | Croley | 220/495.06 |
| 4,557,406 | 12/1985 | Olinger et al. | 220/DIG. 6 |
| 4,673,087 | 6/1987 | Webb . | |
| 4,809,851 | 3/1989 | Oestreich, Jr. et al. . | |
| 4,828,132 | 5/1989 | France, Jr. et al. . | |
| 4,917,255 | 4/1990 | Foy et al. . | |
| 4,930,661 | 6/1990 | Voories . | |
| 5,056,667 | 10/1991 | Coohan . | |
| 5,269,414 | 12/1993 | D'Hollander . | |
| 5,419,448 | 5/1995 | Watson . | |
| 5,480,057 | 1/1996 | Papaluca | 220/495.06 |
| 5,505,323 | 4/1996 | Naoki et al. . | |
| 5,622,279 | 4/1997 | Schultz | 220/571 |

*Primary Examiner*—Joseph M. Moy
*Attorney, Agent, or Firm*—Michael B. Jolly

[57] ABSTRACT

A collapsible container is provided adaptable for use on a standard industry pallet and which includes an option of utilizing a bottom discharge port. The container includes four wall frame members each with a replaceable wall panel attached to the inside surface of each wall frame member so that when the panels are assembled there is a continuous plastic surface on the interior of the container thereby reducing contact of the metal parts of the frame members to corrosive chemicals and further reducing the possibility of tearing or puncturing a plastic inner liner inserted into the interior of the container. The wall frame members are assembled using a rounded post and inverted V notch connecting means positioned along the side edges of the wall frame members which reduces the possibility of snagging or tearing the plastic inner liner when inserting it into the interior of the container. A foam block floor may be optionally inserted into the interior of the container and includes a passageway extending from the bottom surface of the container to a side location of one of the wall frame members, while a 90° elbow is attached to the discharge port on the plastic inner liner and inserted through the passageway when installing the liner thereby providing a bottom discharge port for the container.

3 Claims, 5 Drawing Sheets

COLLAPSIBLE SHIPPING CONTAINER

FIELD OF THE INVENTION

The present invention relates to shipping containers and more particularly to a collapsible shipping container which is suitable for use on a standard wooden pallet and which includes a bottom discharge closure allowing for the complete removal of the liquid before disposal of the liner. The collapsible container also includes improved tubular frame construction with post and V notch attachments reducing the number of exposed metal edges and further an improved interior panel which eliminates interior metal parts that may become exposed to the shipping contents and which further prevents inadvertent punctures of the plastic liner.

BACKGROUND OF THE INVENTION

Intermediate bulk containers have been developed for shipping liquid which are the general shape of a rectangle or a standard pallet. Many of these containers are adapted to utilize a disposable liner which is an inner plastic bag that contains the shipped material while the bag is confined within the container, the bags are generally disposed after use. Some of these containers are collapsible, so that after the shipment has been received and the contents emptied from the disposable liner, the container is disassembled and secured for shipment back to the supplier. These collapsible containers are provided with either a built in pallet, or are adaptable for use on an industry standard pallet. When shipping liquid, a problem encountered with using a standard pallet and many containers with built in pallets, a bottom discharge container cannot be used. Furthermore using a standard pallet with a side discharge container does not allow the end user to quickly and efficiently empty a liquid filled liner. The use of collapsible containers that include a built in pallet with a bottom discharge port are extremely expensive and additionally when the pallet portion of these containers is damaged the entire container must be discarded. The present invention overcomes these problems by providing a collapsible shipping container that is adaptable for use on any standard industry pallet and which provides a bottom discharge port so that the container may be used for shipping liquids.

The present device provides a collapsible lightweight intermediate bulk liquid shipping container which is constructed of four wall frame members with wall panels which wall frame members are assembled upon a standard size pallet, while a rigid formed foam block floor is inserted into the assembled container forming a floor in the container, a passageway is provided through the foam block floor and extends to an exterior side of one of the wall frame members, an inner liner with a 90° elbow connected to the liner discharge port is inserted into the container while the elbow is inserted through the passage way and out to the exterior side of a wall frame member. The container is lighter than most prior devices and constructed of durable reusable materials allowing the container to be reused and shipped in a collapsible state. Furthermore, the wall panels are constructed of durable corrugated plastic and form a continuous plastic interior of the assembled container thereby eliminating exposure of any metal parts of the container from being exposed to the possibly corrosive chemicals shipped and reducing the possibility of puncturing of the plastic liner. Additionally, the wall frame members are quickly and easily assembled with numerous rounded upturned post and inverted V notched tabs which reduces the number of sharp edges exposed on the exterior of the assembled container thereby reducing injuries and snagging and tearing of the plastic liners.

PRIOR ART

Prior devices designed for use with plastic inner bags and which are collapsible, which are incorporated with a pallet type base, containers which are formed from injected plastic pieces and corrugated disposable containers are summarized below.

Mansouri U.S. patent application Ser. No. 08/810,233 discloses and claims a collapsible shipping container with wall frame members including corrugated plastic wall panels which is suitable for use on a standard pallet however the present invention provides a substantial improvement in that the present invention is includes a bottom discharge port which is more suitable for shipping liquids and includes corrugated plastic wall members that form a continuous plastic interior thereby eliminating exposure of the container's metal parts to corrosive products and further preventing inadvertent punctures and tears of the plastic liner. The present invention also includes an improved wall frame member connecting means that allows a user to quickly and easily assembly the wall frame members that includes numerous upturned rounded post that mate with inverted V notched tabs positioned along the wall frame member side edges. The connecting means reduces the number of exposed edges on the assembled container thereby reducing injuries of the users and preventing plastic liner damage.

Kirdle, U.S. Pat. No. 3,266,656 discloses a knockdown container constructed of side panels of relatively thin construction without any reinforcing frame members. This device is extremely useful for its stated purposes however it is not adaptable for shipping liquids which exert heavy loads on the side panels requiring substantially reinforced wall panels. Kirdley accordingly is not adaptable to use for shipping liquids as the present invention.

Voorhies, U.S. Pat. No. 4,930,661 discloses a one-way corrugated cardboard liquid shipping container with an inner plastic liner with a side discharge. This invention is useful for its stated purposes however it is not collapsible and reusable as the present invention. Furthermore, the Voories container does not include a bottom discharge port as the present invention and it is not adaptable to include a bottom discharge port since a standard pallet is utilized. The present invention is reusable, economical, utilizes a standard pallet and includes a bottom discharge port so that liquids are easily completely drained from the container prior to discarding the liner.

Webb, U.S. Pat. No. 4,673,087 teaches a knockdown container constructed of plastic corrugated construction but without any metal frame work support. The Webb is useful for its stated purposes however it is unsuitable for shipping liquids which exert heavy loads on the shipping container side panels. In order for a container of cubic shape to withstand the forces exerted by shipping liquids substantial reinforcement of the side panels is required. The present invention provides the necessary reinforced side panels in addition to an interior which has plastic corrugated panels continuous therein thereby eliminating edges that may inadvertently damage the inner plastic liner and eliminating exposure of the metal framed side panels to corrosive chemicals.

Naoki, et al., U.S. Pat. No. 5,505,323 discloses an interlocking-assembled container with a bottom member provided with a female locking means lockingly engaged with a plurality of side members. The present invention utilizes an existing pallet for the bottom member allowing the device to be inexpensively and quickly adapted to existing equipment while also providing replaceable wall panels for the wall frame members.

Watson, U.S. Pat. No. 5,419,448 discloses a knock down storage container comprising a base with side walls pivotally connected to the base. The present invention utilizes an existing pallet for the bottom member while also including a bottom discharge port for effectively removing all liquid contents from the container the device is relatively inexpensive and quickly adapted to existing equipment also allowing for easy replacement of the pallet if damaged.

Streich, et al., U.S. Pat. No. 5,289,933 discloses a collapsible cargo container integrally designed with a bottom member and a plurality of side walls which are releasable connected to the bottom member with plug-in connectors located at the comers of the bottom member. The present invention utilizes an existing pallet for the bottom member with pallet retaining tabs on the side members allowing the device to be inexpensively and quickly positioned upon a pallet and secured with straps for shipping, allowing for adaption to existing equipment also allowing for easy replacement of the pallet if damaged, while also providing a bottom discharge collapsible container.

D'Hollander, U.S. Pat. No. 5,269,414 discloses an intermediate collapsible bulk container with four sides foldablely attached to a base, the base further serving as staggered support for stacking the folded side walls flatly for reshipping the collapsed container. The present invention utilizes an existing pallet for the bottom member while an insert into the interior of the assembled container provides a means for adapting the container to a bottom discharge container if desired, allowing for adaption to existing equipment also allowing for easy replacement of the pallet if damaged.

Other patents that describe various collapsible containers include: U.S. Pat. No. 5,056,667; U.S. Pat. No. 4,917,255; U.S. Pat. No. 4,828,132; U.S. Pat. No. 4,809,851; and U.S. Pat. No. 4,715,508. As can be seen from reviewing the prior art containers, there has never been collapsible container suitable for shipping liquid and which is adaptable to fit upon a standard industry pallet and which includes a bottom discharge port for effectively removing all liquid from the container before discarding the plastic inner liner.

SUMMARY OF THE INVENTION

It is accordingly an object of the present invention to provide a collapsible container suitable for shipping liquid and suitable for use with a standard industry pallet and which includes a bottom discharge port.

It is a further object of the present invention to provide a collapsible container that includes four wall frame members each constructed of tubular frame members and which include a replaceable wall panel attached to an inside surface of each wall frame member so that when the wall frame members are assembled there is a plastic interior surface on all wall surfaces thereby eliminating contact of metal parts with corrosive chemicals which may spilled or leak from the plastic inner liner and also reducing the likelihood of tearing or puncturing the plastic inner liner.

It is a still a further object of the present invention to provide a collapsible container that includes four wall frame members that are easily and quickly assembled by a post and notch connecting means which includes a plurality of upturned rounded posts attached to side edges of two the wall frame members and a plurality of inverted V notched tabs attached to side edges of the other two wall panel members and in alignment with the rounded post so that the wall panel members are easily and quickly assembled.

Accordingly a collapsible container is provided adaptable for use on a standard industry pallet and which includes an option of utilizing a bottom discharge port. The container includes four wall frame members each with a replaceable wall panel attached to the inside surface of each wall frame member so that when the panels are assembled there is a continuous plastic surface on the interior of the container thereby reducing contact of the metal parts of the frame members to corrosive chemicals and further reducing the possibility of tearing or puncturing a plastic inner liner inserted into the interior of the container. The wall frame members are assembled using a rounded post and inverted V notch connecting means positioned along the side edges of the wall frame members which reduces the possibility of snagging or tearing the plastic inner liner when inserting it into the interior of the container. A foam block floor may be optionally inserted into the interior of the container and includes a passageway extending from a top surface of the foam block to a side edge of the foam block which is in alignment with an aperture located on one of the wall frame members, while a 90° elbow is attached to the discharge port on the plastic inner liner and inserted through the passageway when installing the liner thereby providing a bottom discharge port for the container. The container provides an inexpensive and practical alternative to the prior art by allowing the container to be placed upon an existing pallet, provides a bottom discharge container without the need for purchasing expensive containers with built in pallets, and further provides wall frame member connecting means that reduces liner punctures and tears and plastic wall panels that prevent corrosion of the metal frame members and additionally prevents liner punctures and tears. The invention provides less expensive product and a lighter product which results in lower shipping cost, and further a container which can be used repeatedly even if the pallet is damaged since the pallet can be replaced. Furthermore the device can be shipped disassembled by simply stacking and strapping the sidewall members and foam block floor upon the pallet. While the devices component, such as the plastic wall panels can be replaced if damaged.

DETAILED DESCRIPTION OF THE DRAWINGS

It can be seen from the following description that in use, the collapsible container is composed of four wall panel members which are easily assembled by the use of the wall frame member connecting means which includes a plurality of upturned rounded post securely attached to the side edges of two wall frame members while the other two wall panel members include a plurality of inverted "V" notched tabs securely attached to the side edges and in alignment to retain the rounded post. The wall frame members include wall panels attached to an inside surface so that when the wall frame members are assembled a continual plastic surface is provided throughout the interior of the container. The wall frame members are preferably assembled on a standard pallet or may be assembled off a pallet and then set upon a pallet if desired. After placing the assembled wall frame members on the pallet, if a bottom discharged container is desired, a foam floor block is placed in the bottom of the container. The foam floor block includes a passage way which runs through the block from an upper surface of the block to an outside edge of the block so that when a 90° elbow from the cassette, which contains the inner plastic lining with a bottom discharge port, is inserted through the passage way the discharge is positioned on a side of one of the wall frame members, thereby providing a bottom discharge for the container. After the cassette plastic liner is placed in the interior of the assembled wall frame members, the contents desired to be shipped are placed within the liner. A corrugated top with perimeter skirts is placed over the assembled and filled container while retaining straps extend over the corrugated top and under the pallet that secure the assembled container onto the pallet.

Figure 1:
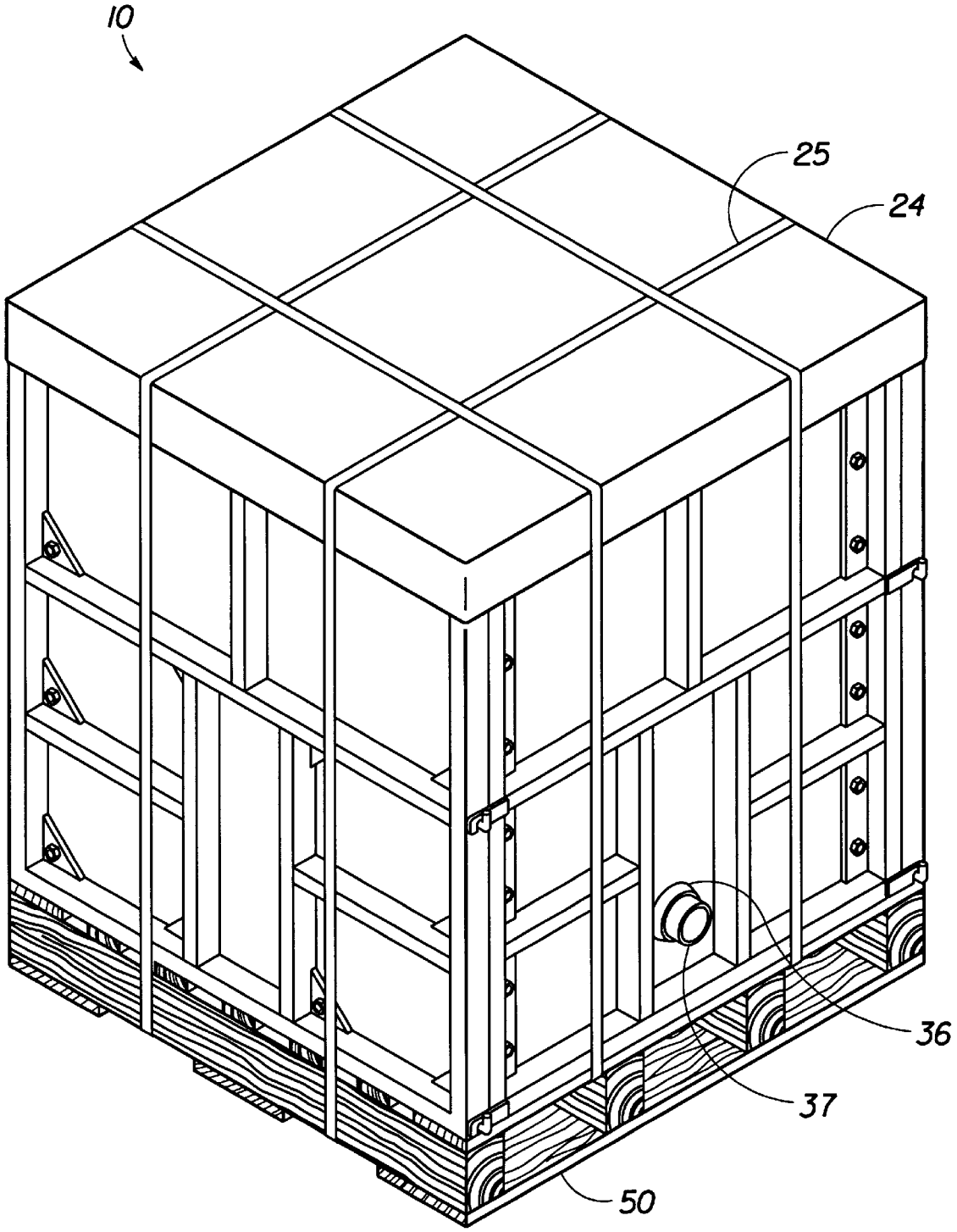
FIG. 1 is a perspective view of the collapsible container assembled upon an industry standard wooden pallet.
Figure 2:
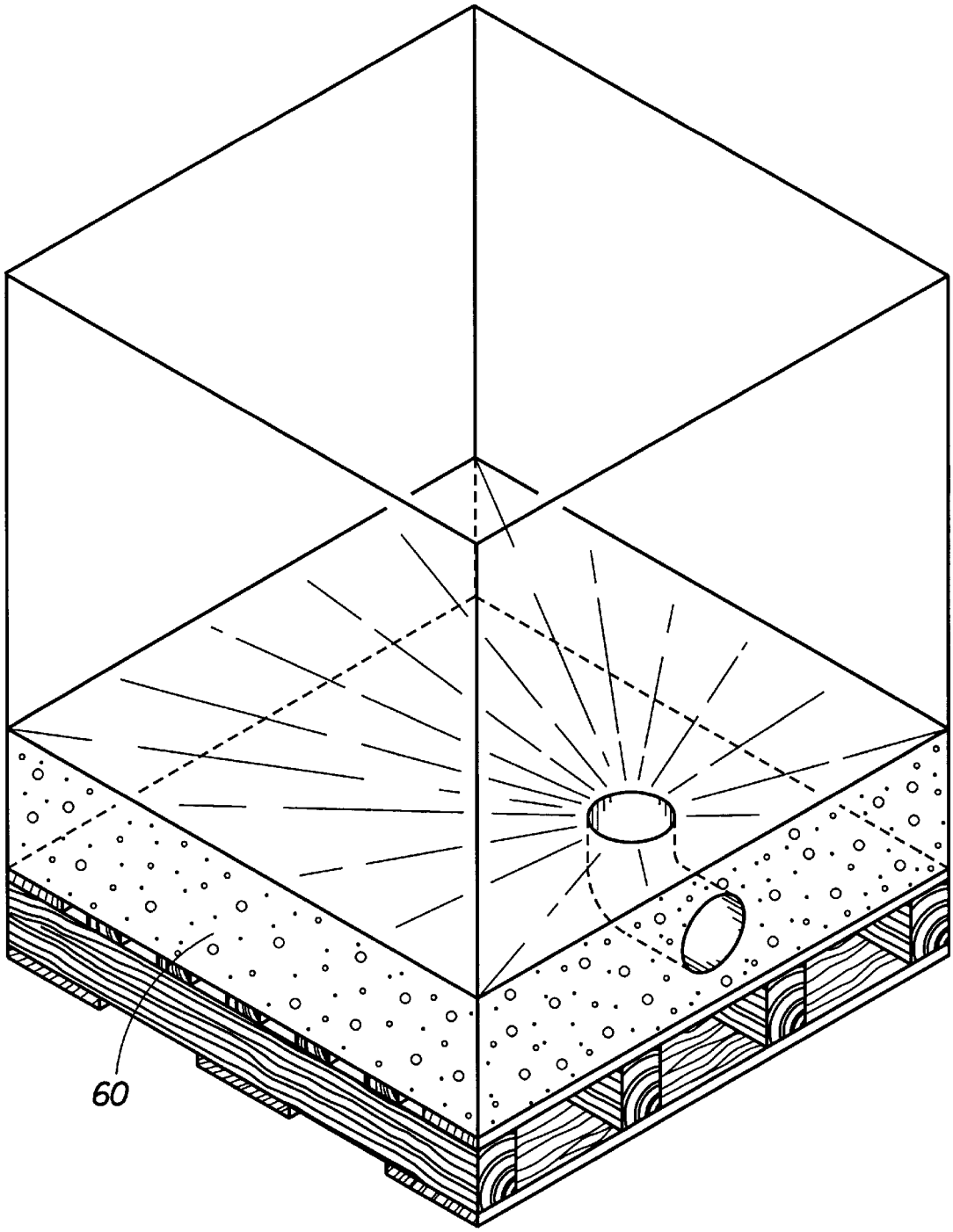
FIG. 2 is a perspective view of the interior of the container illustrating the placement of the foam block floor therein.
Figure 3:
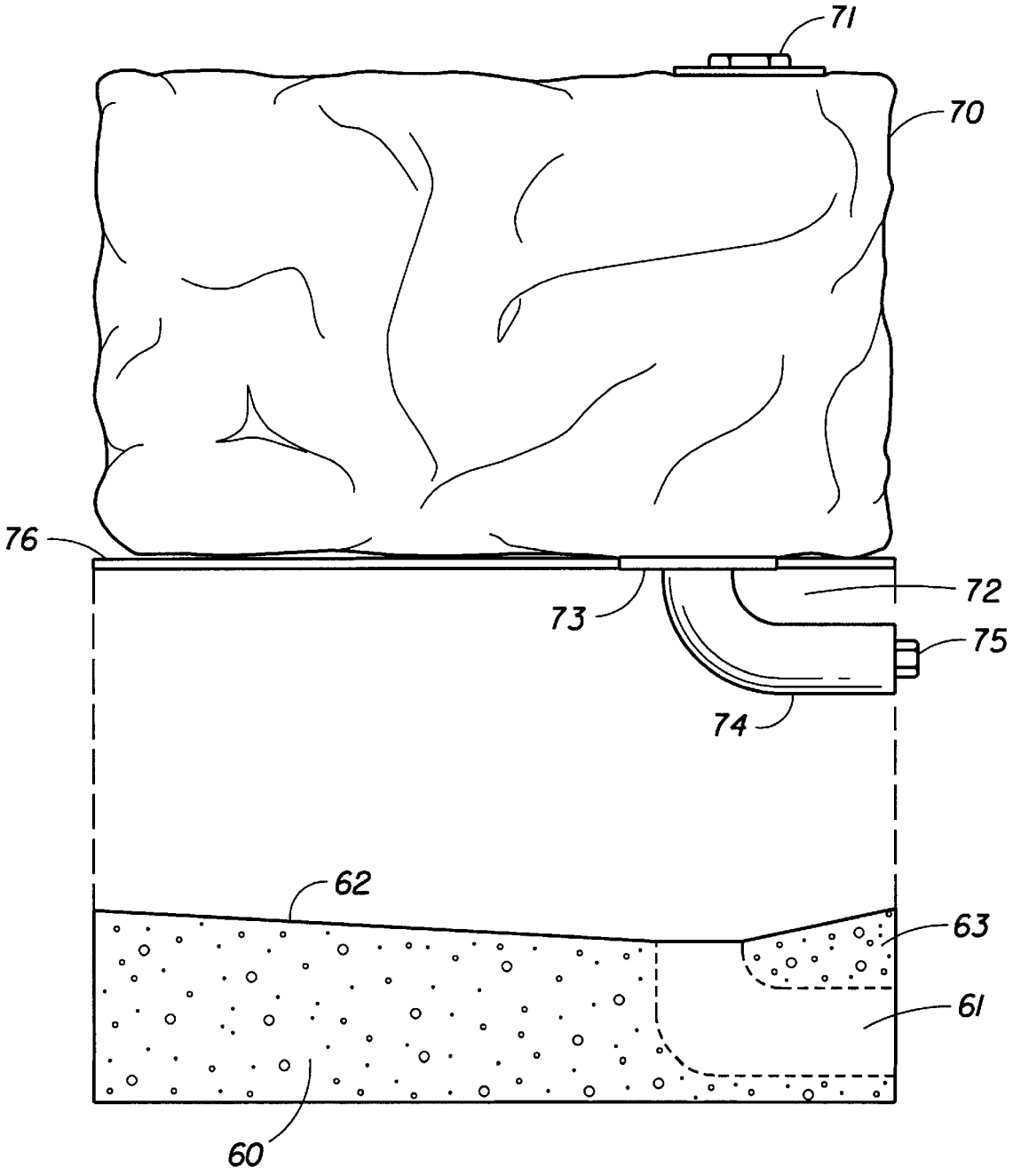
FIG. 3 is a partial cross sectional side view of a foam block floor and a plastic inner liner fitted with 90° elbow.
Figure 4:
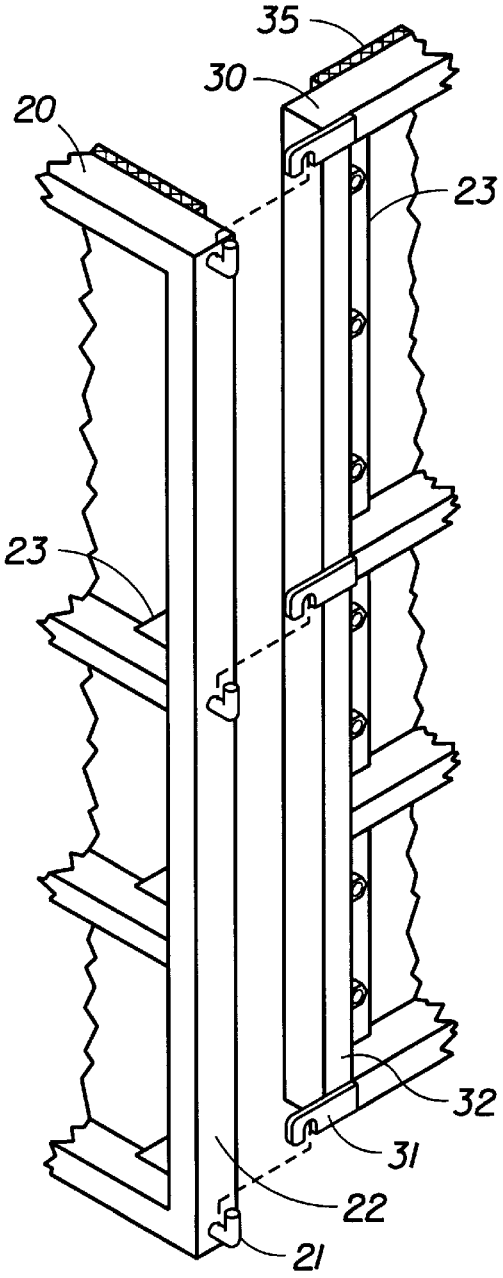
FIG. 4 is an isometric view of two wall frame members illustrating the wall frame member connecting means which includes three upturned rounded post connected to one edge of one wall frame member and three inverted "V" notched tabs attached to a side edge of the other wall panel member.
Figure 5:
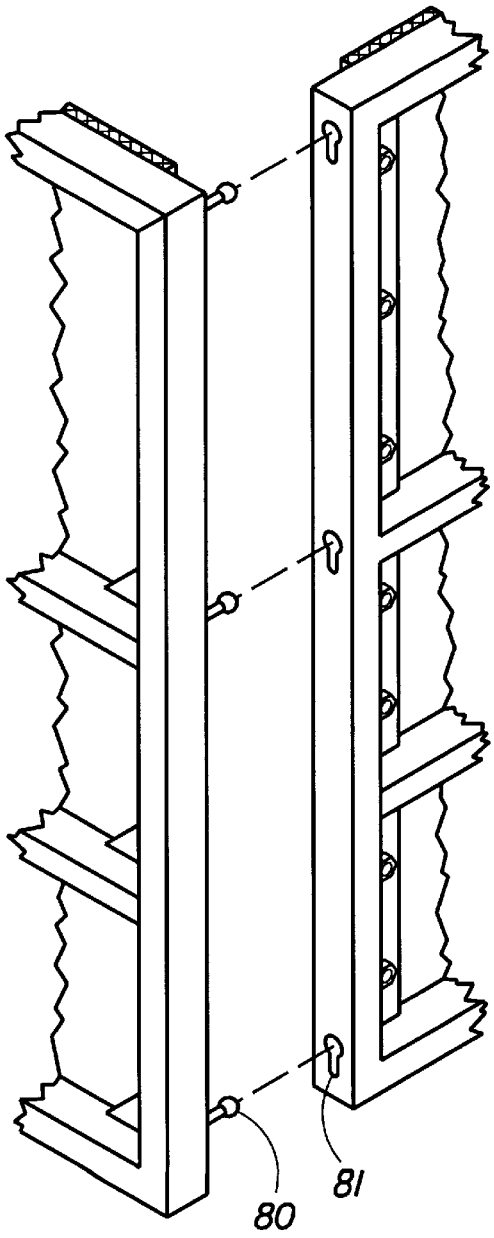
FIG. 5 is an isometric view of two wall frame members illustrating an alternative wall frame connecting means which includes three headed pegs connected to one edge 6 one wall frame member and three elongated retention holes for receiving the pegs in the side edge of the other wall panel member.

Referring to the figures in detail, FIG. 1 is an isometric view of the assembled container 10 securely strapped to a standard pallet 50. The standard pallet 50 is considered an industry standard size and is rectangular measuring approximately forty inches by forty eight inches. The device may also be used on pallets of other sizes without deviating from the invention hereof. The container includes four wall panel members which are assembled to form the container. Two of the wall frame members, which when assembled are positioned on opposing sides of the container, are identical. The wall panel members are constructed utilizing squared tubing, which adds sufficient strength without having edges exposed which may snag on or tear the inner plastic liner. The square tubing which is used to construct the wall frame members are joined with welds and preferably sanded smooth and coated with a corrosive inhibiting paint. FIG. 4 illustrates a close up view of the wall frame members connection means. Two of the wall frame members 20 includes three upturn "J" shaped rounded post 21 which are securely welded to the side edges 22 of the wall frame members 20. The opposite side edge of wall frame member 20 includes identical placement of "J" shaped upturn rounded post. Additionally, the wall frame member which is on the opposing side of the container as wall frame member 20 includes identical arrangement of these upturn "A" shaped rounded post. The two other wall frame members which attach to the upturn "J" post 30 includes metal tabs 31 securely welded to the side edge 32 of the wall frame member 30. The tabs include inverted "V" notches which are positioned to align with the upturn "J" post. The wall frame members are assembled by positioning the inverted "V" notches above the upturn "J" post and then downwardly sliding the inverted "V" notches over the upturn "J" post to securely attach the wall panel members. The opposing side edge of wall frame member 30 includes identical placement of connecting tabs 31 while the opposing wall frame member includes identical connecting tabs 31. There may be additional means for attaching the wall frame members such as a straight round post with an enlarged head which fits within an elongated hole. FIG. 5 illustrates a alternative wall frame member connecting means which includes three straight round enlarged head post 80 attached to a side edge of a wall frame member while three elongated receiving holes 81 are provided in the other wall frame member for receiving and lockingly engaging the wall frame members.

Figure 6:
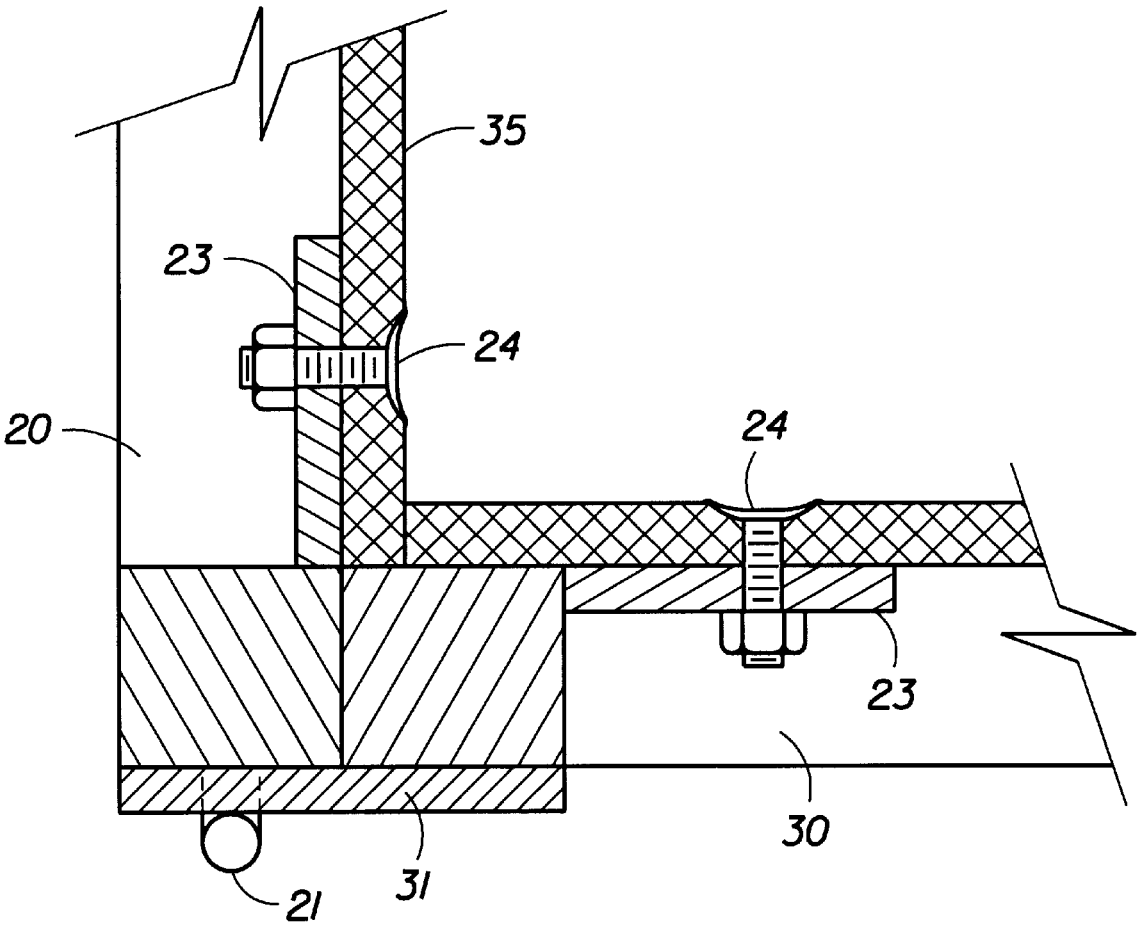
FIG. 6 is a cross section of a corner illustrating the connecting means and the wall panel attachment to the wall frame member.

FIG. 6 illustrates a cross sectional top view of a corner of the assembled container illustrating the connection of the wall frame members. Each of the wall frame member includes elongated mounting members 23 used for mounting an inner wall panel 35. The inner wall panel 35 is dimension to cover the entire interior surface of the wall frame members so that when the wall frame members are assembled a continuous plastic surface is provided on the interior of the container walls. The plastic wall panel is preferably constructed of corrugated plastic. The corrugated plastic is readily attached to the mounting tabs 23 by use of elevator bolts 24 the elevator bolts 24 provide a flat surface on an interior of the container so that an inserted plastic inner liner is not snagged or torn by the retaining bolts. On one panel member an aperture 36 is cut to provide an exit for a side discharge 37 although both panel members may be adapted to include an exit for a side discharge.

After the four wall panel members have been assembled on top of a pallet, a user may, if a bottom discharge container is desired place a foam floor block 60 in the bottom of the container. The foam floor block 60 includes a internal passage way 61 which extends from an upper surface 62 of the foam floor block and exits at a side edge 63. The side edge exit is positioned to be in alignment with the aperture 36 in the wall panel. The top surface of the foam floor block is preferably sloped from all edges toward the passage way 61, this assures that all liquid is drain from the container when desired. The inner liner plastic bag 70 is a standard inner liner and includes a filling port 71 and a drainage port 72 and the entire inner liner is supplied as a cassette with a corrugated paper bottom 76. The corrugated paper bottom 76 is rectangular and the same dimensions as the interior of the assembled container. The standard inner liner plastic bag includes an expanded collar 73 for securely attaching the plastic liner to the discharge port 72. The expanded collar, when attempted to be used in a side discharge orientation, prevents a user from affectively withdrawing all liquid from the container because the expanded collar lifts the discharge port a small distance from the bottom the container. The use of the present invention with the foam floor block allows all contents to be drained affectively without having to dangerously tilt the pallet to drain the interior. A 90° elbow 74 is attached to the discharge port 72. The 90° elbow is preferably a PCV pipe and includes a plug 75. The passage way 61 is preferably a sufficient diameter to allow the 90° elbow to be easily inserted through the passage way. Furthermore, the 90° elbow is dimensioned so that after it has been inserted into the passageway 61 the plug 75 is easily accessible from the outside of the container.

The foam floor block 60 is preferably constructed of a rigid closed cell foam such as polyurethane or styrofoam. Additionally, the foam block may be coated with a material to help prevent deterioration over time.

The assembled container as shown in FIG. 1 includes a skirted top 24 which may be constructed of corrugated plastic and/or cardboard. The assembled and filled container along with the skirted top is secured to the pallet utilizing shipping securing straps 25. After the container has been shipped and emptied by a user, the shipping container is disassembled, the wall frame members are then stacked on the pallets along with the foam floor block, and then ship back to the supplier.

I claim:

1. A collapsible shipping container suitable for use on a standard industry wooded pallet, comprising:

a) four wall frame members constructed of tubing and each having side edges and a top edge and a bottom edge, wherein the wall frame members are dimensioned to form upright walls for the collapsible container positioned on the pallet, two of the wall frame members include a plurality of "J" shaped rounded upturned post attached on both side edges, while the other two wall frame members include a plurality of inverted "V" notched tabs attached to both side edges, the inverted V notched tabs are aligned on the side edges to mate with the J posts on an adjacent wall frame member so that a ninety degree corner is formed between two adjacent wall frame members when the inverted V notched tabs are aligned over corresponding J posts and downwardly mated to engage and retain the J posts within the inverted V notches on an adjacent wall frame member, joining of the other three comers of an assembled container is accomplished by mating the J posts with the inverted V notched tabs, b) four interior wall panels attached to an interior surface of the wall frame members so that after the wall frame members are assembled the wall panels form a continuous surface on an interior wall surface of the assembled container, c) a foam floor block positioned on an interior floor of the assembled container which foam floor block comprises a top surface and side edges while a passageway extends through the top surface to a side edge of the foam floor block, the passageway is indented on the top surface which forms the lowest level on the top surface so that all liquid in the container drains toward the passageway, d) a plastic inner liner insertable within the interior of the assembled wall frame members used for containing liquid within the interior of the assembled container and which includes a filling port and a discharge port while a ninety degree elbow pipe is connected to the discharge port which includes a discharge port plug, while the plastic inner liner is inserted into the interior of the assembled container the elbow is inserted through the passageway and out an aperture in a wall panel so that the discharge port plug is accessible from an outside of the container, and e) a skirted top cap dimensioned to fit around and on top of the assembled wall frame members which is secured in place utilizing shipping securing straps which are wrapped around the container top and through the pallet thereby securing the container top and securing the container on the pallet.

2. The collapsible container as set forth in claim 1 wherein the wall panels further comprise wall panels which are secured to the wall frame members utilizing elevator bolts with flat heads so that there are no projections into the interior of the assembled wall frame members.

3. The collapsible container as set forth in claim 1 wherein the wall panels further comprise wall panels which are constructed of corrugated plastic which thereby resist deterioration and prevents corrosive material from contacting metal members of the wall frame members.

* * * * *